US008234722B2

(12) United States Patent
VanDerWoude et al.

(10) Patent No.: US 8,234,722 B2
(45) Date of Patent: Aug. 7, 2012

(54) PERSONAL PROTECTION SYSTEM WITH HEAD UNIT HAVING EASY ACCESS CONTROLS AND PROTECTIVE COVERING HAVING GLARE AVOIDING FACE SHIELD

(75) Inventors: Brian James VanDerWoude, Portage, MI (US); Douglas Lee Campbell, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 1038 days.

(21) Appl. No.: 11/957,062

(22) Filed: Dec. 14, 2007

(65) Prior Publication Data

US 2009/0151054 A1 Jun. 18, 2009

(51) Int. Cl.
*A42B 1/06* (2006.01)

(52) U.S. Cl. ..... 2/410

(58) Field of Classification Search ..... 2/410, 4, 2/15, 171, 171.3, 202, 206; 128/201.23, 128/201.24, 857, 858, 863
See application file for complete search history.

(56) References Cited

U.S. PATENT DOCUMENTS

| | | | |
|---|---|---|---|
| 1,037,206 | A | 9/1912 | Clifford |
| 1,766,272 | A | 2/1930 | Vallier |
| 2,739,310 | A | 3/1956 | Frieder et al. |
| 3,018,776 | A | 1/1962 | Saitta et al. |
| 3,025,525 | A | 3/1962 | Larson |
| 3,048,776 | A | 8/1962 | Logan |
| 3,058,463 | A | 10/1962 | Goodrich, Jr. |
| 3,214,809 | A | 11/1965 | Edwards |
| 3,529,594 | A | 9/1970 | Charnley |
| 3,803,640 | A | 4/1974 | Ericson |
| 3,822,698 | A | 7/1974 | Guy |
| 3,881,198 | A | 5/1975 | Waters |
| 3,950,112 | A | 4/1976 | Crump et al. |
| 3,955,570 | A | 5/1976 | Hutter, III |
| 4,019,508 | A | 4/1977 | Der Estephanian et al. |
| 4,038,979 | A | 8/1977 | McCosker |

(Continued)

FOREIGN PATENT DOCUMENTS

FR 2 082 412 A 12/1971

(Continued)

OTHER PUBLICATIONS

EPO ISA Search Report and Written Opinion for PCT App. No. PCT/US2008/086189, May 2009.

*Primary Examiner* — Alissa L Hoey
*Assistant Examiner* — Amber Anderson
(74) *Attorney, Agent, or Firm* — Howard & Howard Attorneys PLLC

(57) ABSTRACT

A personal protection system is provided for creating a sterile barrier between a user and an external environment. The personal protection system includes a head unit having a ventilation unit with a fan for distributing air to the user. The personal protection system also provides a protective covering draped over the head unit. The protective covering includes a flaccid shroud and a transparent face shield mounted to the flaccid shroud. The face shield is mounted to the head unit using a plurality of mounting elements. The face shield is mounted such that a top portion of the face shield has a larger radius of curvature when mounted that a bottom portion of the face shield. This reduces the glare directed toward the user. A control panel for the ventilation unit is also provided on a chin bar of the head unit for easy access by the user.

25 Claims, 9 Drawing Sheets

U.S. PATENT DOCUMENTS 4,055,123 A 10/1977 Heidelberg
4,055,173 A 10/1977 Knab
4,133,308 A 1/1979 Lowe et al.
4,136,688 A 1/1979 Gorman
4,280,491 A 7/1981 Berg et al.
4,296,746 A 10/1981 Mason, Jr. et al.
4,320,256 A 3/1982 Freeman
4,336,799 A 6/1982 Almasi et al.
4,469,097 A 9/1984 Kelman
4,549,541 A 10/1985 Sundahl
4,589,408 A 5/1986 Singer
4,590,951 A 5/1986 O'Connor
4,619,254 A 10/1986 Moretti et al.
4,651,727 A 3/1987 Howorth
4,667,667 A 5/1987 Schnoor et al.
4,672,968 A 6/1987 Lenox et al.
4,674,492 A 6/1987 Niemeyer
4,676,236 A 6/1987 Piorkowski et al.
4,711,033 A 12/1987 Mitchell
4,711,539 A 12/1987 Krusas et al.
4,730,612 A 3/1988 Dampney
4,864,654 A 9/1989 Schriver et al.
4,875,477 A 10/1989 Waschke et al.
4,888,831 A 12/1989 Oleson
4,901,716 A 2/1990 Stackhouse et al.
4,951,662 A 8/1990 Townsend, Jr.
5,003,973 A 4/1991 Ford et al.
5,009,225 A 4/1991 Vrabel
5,042,474 A 8/1991 Williamson
5,048,516 A 9/1991 Soderberg
5,054,479 A 10/1991 Yelland et al.
5,054,480 A 10/1991 Bare et al.
5,069,205 A 12/1991 Urso
5,088,117 A 2/1992 Fulmer
5,104,430 A 4/1992 Her-Mou
5,125,402 A 6/1992 Greenough
5,142,704 A 9/1992 Viemeister et al.
5,142,706 A 9/1992 Layhon
5,237,707 A 8/1993 Lowrie
5,251,334 A 10/1993 Yang
5,253,642 A 10/1993 Stackhouse et al.
5,283,914 A 2/1994 James
5,342,121 A 8/1994 Koria
5,349,949 A 9/1994 Schegerin
5,373,588 A 12/1994 Hede et al.
5,394,566 A 3/1995 Hong
5,410,757 A 5/1995 Vienamo et al.
5,452,712 A 9/1995 Richardson
5,457,502 A * 10/1995 Iida ..... 351/44
5,492,116 A 2/1996 Scarberry et al.
5,503,146 A 4/1996 Froehlich et al.
5,515,843 A 5/1996 Chang
5,525,278 A 6/1996 Krosch et al.
5,533,500 A 7/1996 Her-Mou
5,549,104 A 8/1996 Crump et al.
5,553,500 A 9/1996 Grahn et al.
5,564,124 A 10/1996 Elsherif et al.
5,577,495 A 11/1996 Murphy
5,588,153 A 12/1996 Ignon et al.
5,592,936 A 1/1997 Thomas, Jr. et al.
5,601,078 A 2/1997 Schaller et al.
5,655,374 A 8/1997 Santilli et al.
5,664,566 A 9/1997 McDonald et al.
5,669,375 A 9/1997 Darhrendorf et al.
5,682,618 A 11/1997 Johnson et al.
5,687,713 A 11/1997 Bahr et al.
5,690,095 A 11/1997 Glynn et al.
5,711,033 A 1/1998 Green et al.
5,720,281 A 2/1998 Allen et al.
5,879,493 A 3/1999 Johnson et al.
5,887,281 A 3/1999 Green et al.
6,014,971 A 1/2000 Danisch et al.
6,249,918 B1 6/2001 Lacroix
6,370,695 B2 4/2002 Paris et al.
6,374,823 B1 4/2002 Hajianpour
6,393,617 B1 5/2002 Paris et al.
6,481,019 B2 11/2002 Diaz et al.
6,513,168 B2 2/2003 Paris et al.
6,622,311 B2 9/2003 Diaz et al.
6,711,748 B2 3/2004 Paris et al.
6,751,807 B2 6/2004 Klotz et al.
6,792,944 B1 9/2004 Green et al.
6,796,304 B2 9/2004 Odell et al.
6,973,677 B2 12/2005 Diaz et al.
6,990,691 B2 1/2006 Klotz et al.
7,192,151 B2 3/2007 Clupper et al.
7,200,873 B2 4/2007 Klotz et al.
2003/0182710 A1 10/2003 Klotz et al.
2005/0010992 A1 1/2005 Klotz et al.
2006/0213523 A1 * 9/2006 VanDerWoude et al. ..... 128/863
2007/0028372 A1 2/2007 VanDerWoude et al.
2007/0113324 A1 5/2007 Chen
2009/0126063 A1 * 5/2009 Brown et al. ..... 2/12

FOREIGN PATENT DOCUMENTS

GB 1574311 9/1980
GB 2183488 A 6/1987
WO WO 88/09193 12/1988
WO WO 91/18569 12/1991
WO WO 2007011646 A2 1/2007

* cited by examiner

FIG - 6
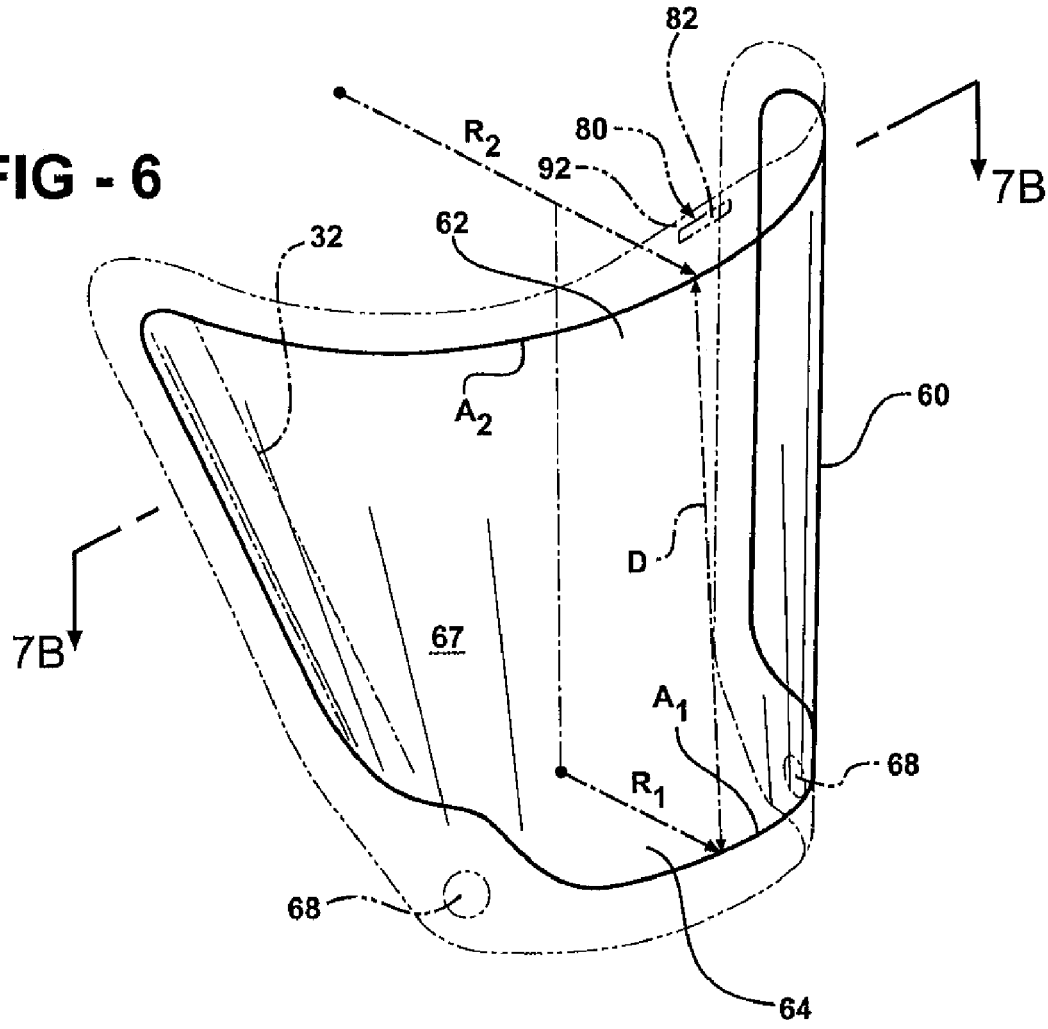
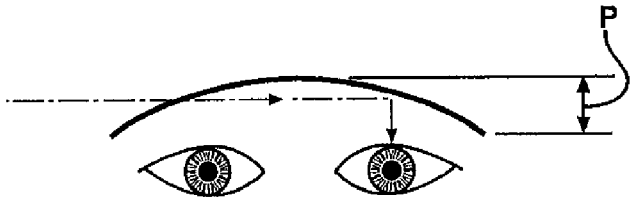
FIG - 7A
PRIOR ART
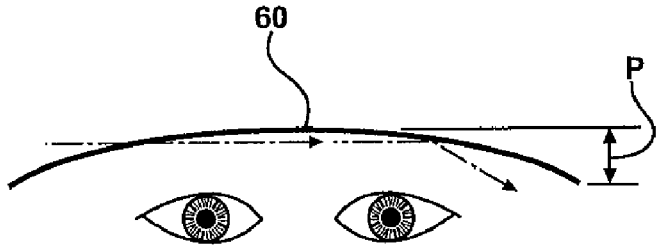
FIG - 7B

PERSONAL PROTECTION SYSTEM WITH HEAD UNIT HAVING EASY ACCESS CONTROLS AND PROTECTIVE COVERING HAVING GLARE AVOIDING FACE SHIELD

FIELD OF THE INVENTION

The present invention generally relates to personal protection systems for use in medical environments, such as surgical environments, to protect patients from contamination during medical procedures, and to protect medical professionals from exposure to airborne contaminants and bodily fluids. More particularly, the present invention relates to protective coverings of personal protection systems and controls for head units of personal protection systems.

BACKGROUND OF THE INVENTION

Personal protection systems are known in the art. Personal protection systems are worn by professionals throughout the medical field, such as surgeons, during surgical procedures. Personal protection systems are used in surgical procedures to provide a sterile barrier between the wearer and the patient. One such system is disclosed in U.S. Pat. No. 5,054,480. Specifically, the traditional system includes a helmet that supports a toga or a hood. This assemblage is worn by surgical personnel that want to establish the sterile barrier. The toga or the hood includes a transparent face shield. The helmet includes a ventilation unit with a fan. The ventilation unit draws air through the toga/hood so the air is circulated around the wearer. This reduces both the amount of heat that is trapped within the toga/hood and the $CO_2$ that builds up in this space.

Conventional personal protection systems do a reasonable job of providing a sterile barrier between the surgical personnel and the surrounding environment. However, there are some limitations associated with their use. The face shields associated with prior art togas/hoods create an undesirable amount of glare. In particular, due to the shape of the face shields utilized, undesirable amounts of light reflect off an inside surface of the face shields and are directed toward the eyes of the wearer. This means that an individual wearing the system may be unable to focus on the area being targeted for surgery.

Furthermore, the helmets of conventional personal protection systems place the controls for the fan of the ventilation unit either on a side of the helmet or on a battery pack used to power the ventilation unit. This location tends to be difficult to navigate for the wearer, especially with the toga/hood covering the controls and the controls being out of the site of the wearer.

SUMMARY OF THE INVENTION AND ADVANTAGES

The present invention provides a personal protection system for providing a sterile barrier between a user and an external environment. The system comprises a head unit adapted to be worn on the head of the user. The head unit includes a support structure and a ventilation unit with a fan supported by the support structure. The ventilation unit discharges air toward the user. A chin bar depends from the support structure.

A protective covering drapes over the head unit. The protective covering includes a flaccid shroud with a filter section for filtering air entering the shroud from the external environment. The protective covering further includes a flexible and transparent face shield. The face shield includes a top portion, a bottom portion, and a sealing perimeter. The shroud seals to the face shield along the sealing perimeter. The face shield is mounted to the head unit with a first radius of curvature along the bottom portion and a second radius of curvature along the top portion. The first radius of curvature is smaller than the second radius of curvature to reduce glare that results from light being reflected off an inside surface of the face shield and directed toward the eyes of the user.

The present invention also provides a protective covering for draping over the head unit. The protective covering includes a flaccid shroud with a filter section for filtering air entering the shroud from the external environment. The protective covering further includes a flexible and transparent face shield. The face shield includes a top portion, a bottom portion, and a sealing perimeter. The shroud seals to the face shield along the sealing perimeter. The face shield supports a pair of lower mounting elements along the bottom portion. The face shield also supports an upper mounting element along the top portion. The upper and lower mounting elements define three mounting locations at which the face shield is to be mounted to the head unit. The three mounting locations provide the face shield with a first radius of curvature along the bottom portion when the face shield is mounted to the head unit using the lower mounting elements and a second radius of curvature along the top portion when the face shield is mounted to the head unit using the upper mounting element. The first radius of curvature is smaller than the second radius of curvature to reduce glare that results from light being reflected off an inside surface of the face shield and directed toward the eyes of the user.

The present invention further provides a personal protection system having a head unit with an easily accessible control panel. The head unit is adapted to be worn on the head of a user. The head unit includes a support structure and a ventilation unit supported by the support structure. The ventilation unit has a fan that discharges air toward the user. A chin bar depends downwardly from the support structure to define a facial opening for the user. The control panel is disposed on the chin bar and includes at least one control switch for the ventilation unit. A protective covering drapes over the head unit. The protective covering includes a flaccid shroud with a filter section for filtering air entering the shroud from the external environment. The protective covering also includes a transparent face shield mounted to the shroud. By placing the ventilation controls on the chin bar, the wearer of the personal protection system has easier access to the controls and can easily locate the controls without much difficulty.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 6 is a front perspective view of the face shield of the protective covering illustrating a first radius of curvature at the bottom of the face shield and a second radius of curvature at the top of the face shield;

FIG. 7A is an illustration of a top of a face shield of the prior art;

FIG. 7B is an illustration of a top of the face shield of the present invention;

DETAILED DESCRIPTION OF THE INVENTION

Referring to the Figures, wherein like numerals indicate corresponding parts throughout the several views, a personal protection system is generally shown at 20.

Figure 1:
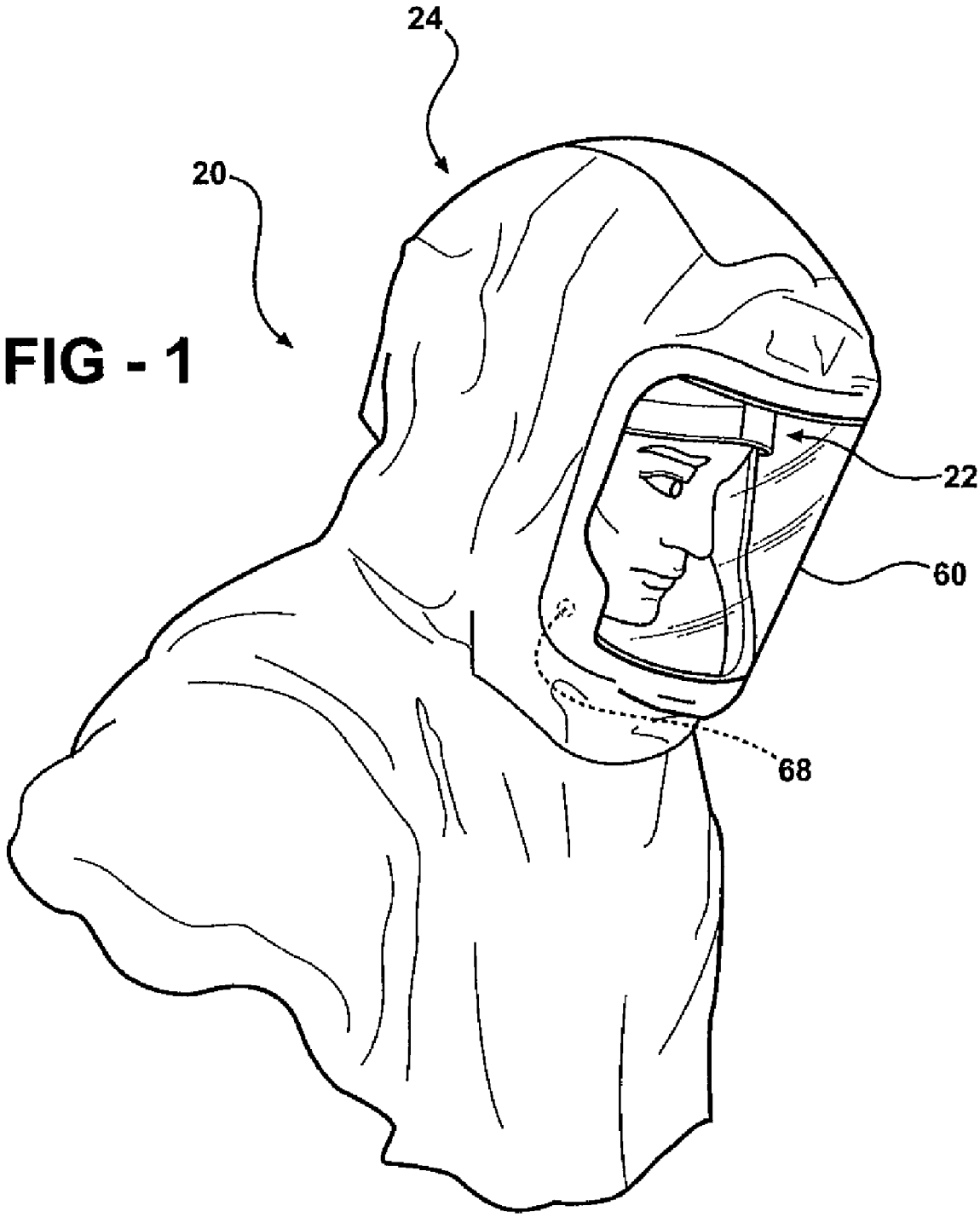
FIG. 1 is a perspective view of a personal protection system including a protective covering draped over a head unit.
Figure 2:
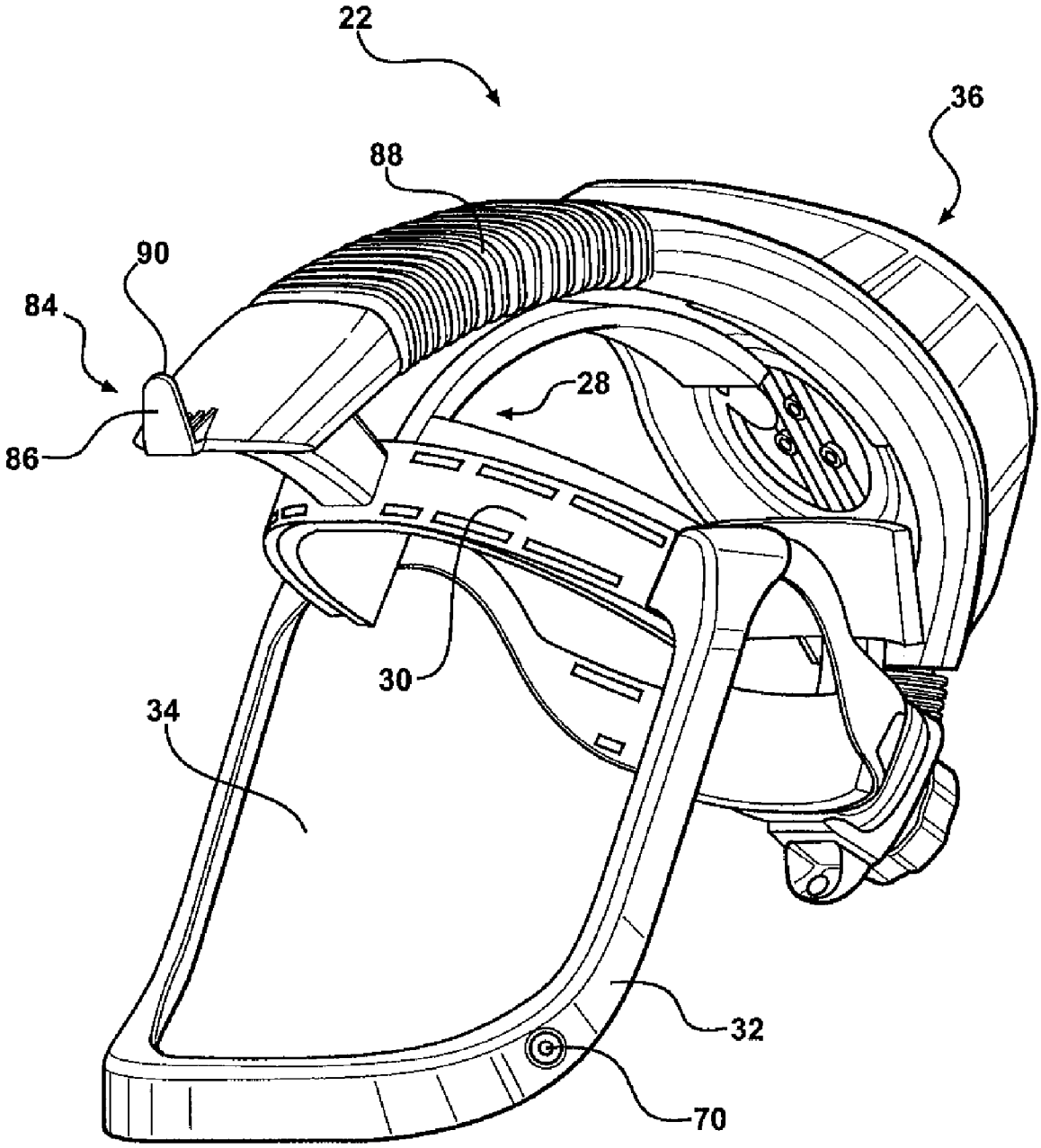
FIG. 2 is a front perspective view of the head unit.
Figure 2A:
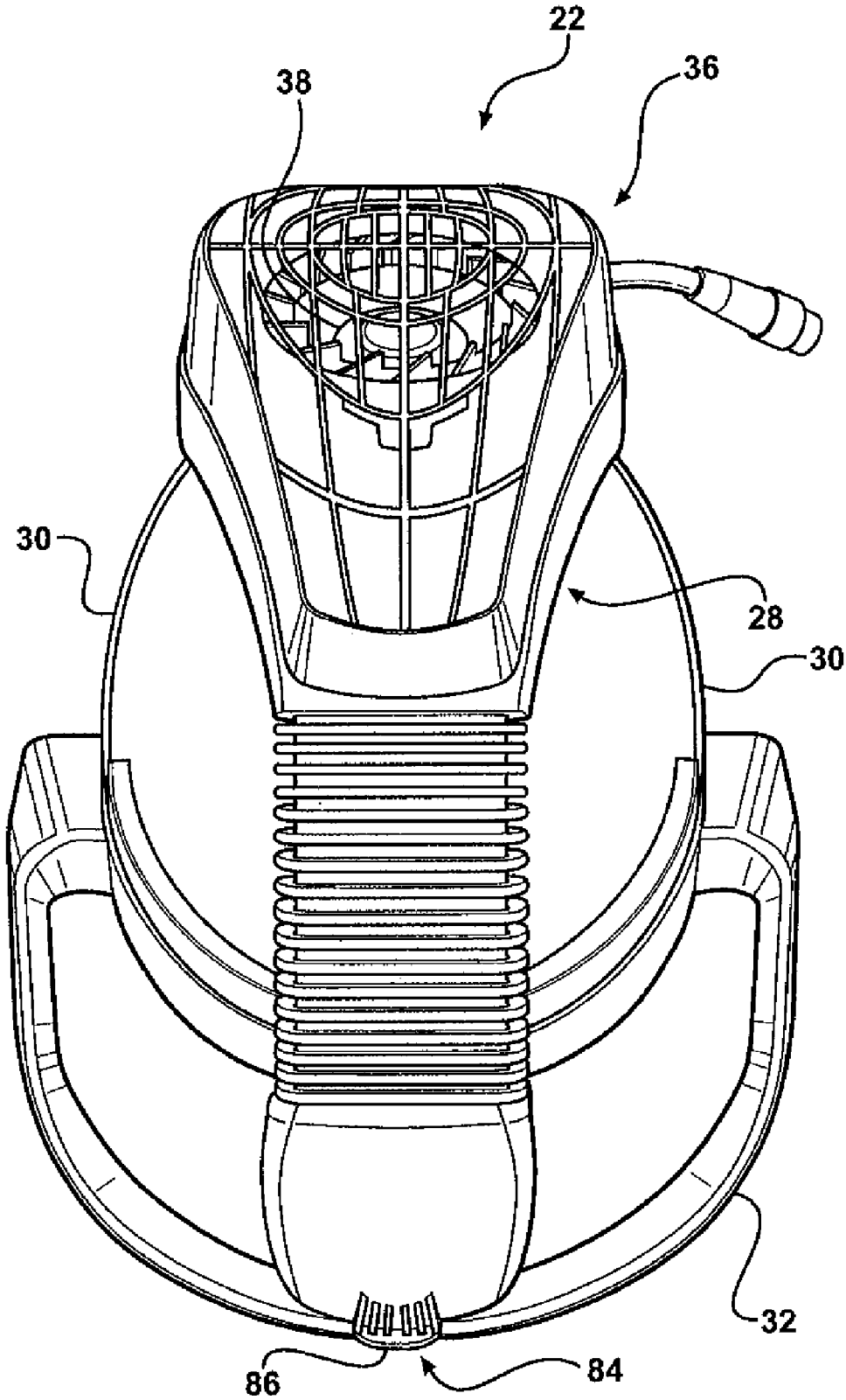
FIG. 2A is a top view of the head unit.

Referring to FIGS. 1, 2, and 2A, the personal protection system 20 is shown to include a head unit 22. The personal protection system 20 also includes a protective covering 24 with an integrated face shield 60 for draping over the head unit 22. The system 20 creates a sterile barrier between the wearer and an external environment. The system 20 is useful in many medical environments, but is particularly adapted for use in surgery to protect patients from contamination during surgical procedures and to protect medical professionals from exposure to airborne contaminants and bodily fluids.

FIGS. 2 and 2A illustrate the head unit 22. The head unit 22 is generally adapted from the head units and helmets shown in U.S. Pat. No. 6,481,019 to Diaz et al. and application Ser. No. 11/485,783 to VanDerWoude et al., both of which are hereby incorporated by reference. The primary difference between the head units or helmets of these documents and the head unit 22 of the present invention is the mounting locations at which the face shield 60 is mounted to the head unit 22. Otherwise, the head units or helmets disclosed in these references are suitable for use in the personal protection system 20 of the present invention.

The head unit 22 includes a support structure 28. The support structure 28 includes an adjustable head band 30 for mounting the head unit 22 to a head of the user. A chin bar 32 depends downwardly from the head band 30 to define a facial opening 34. The support structure 28 also supports a ventilation unit 36. The ventilation unit 36 includes a fan 38 for generating air flow to direct air toward the user. In some embodiments, the support structure 28 also supports a communications unit 40 including a microphone 42 (see FIGS. 12 and 13). Details of the support structure, 28 head band 30, ventilation unit 36, fan 38, and communications unit 40 are disclosed in application Ser. No. 11/485,783 to VanDerWoude et al., hereby incorporated by reference.

Figure 3:
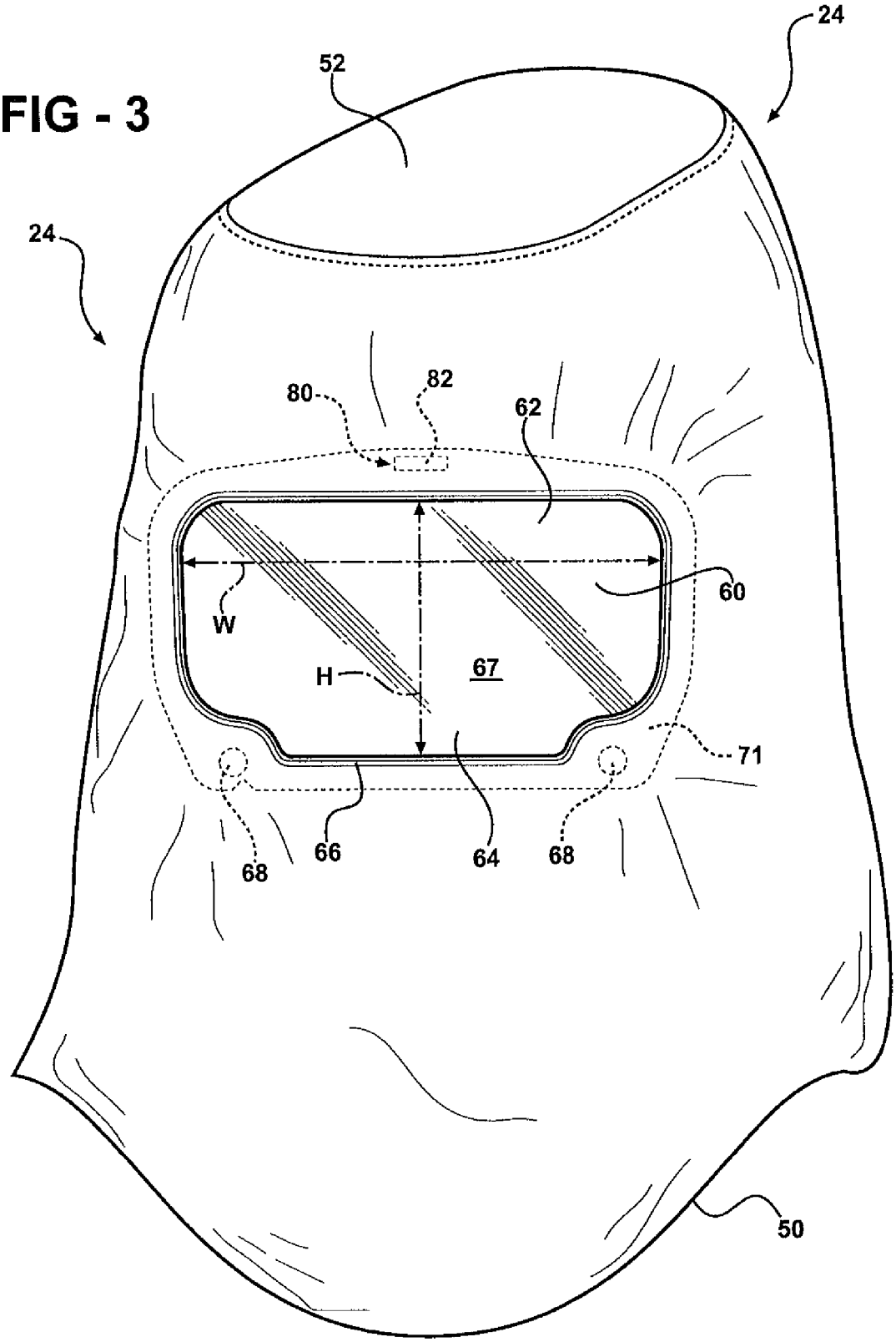
FIG. 3 is a front view of the protective covering including a face shield.
Figure 4:
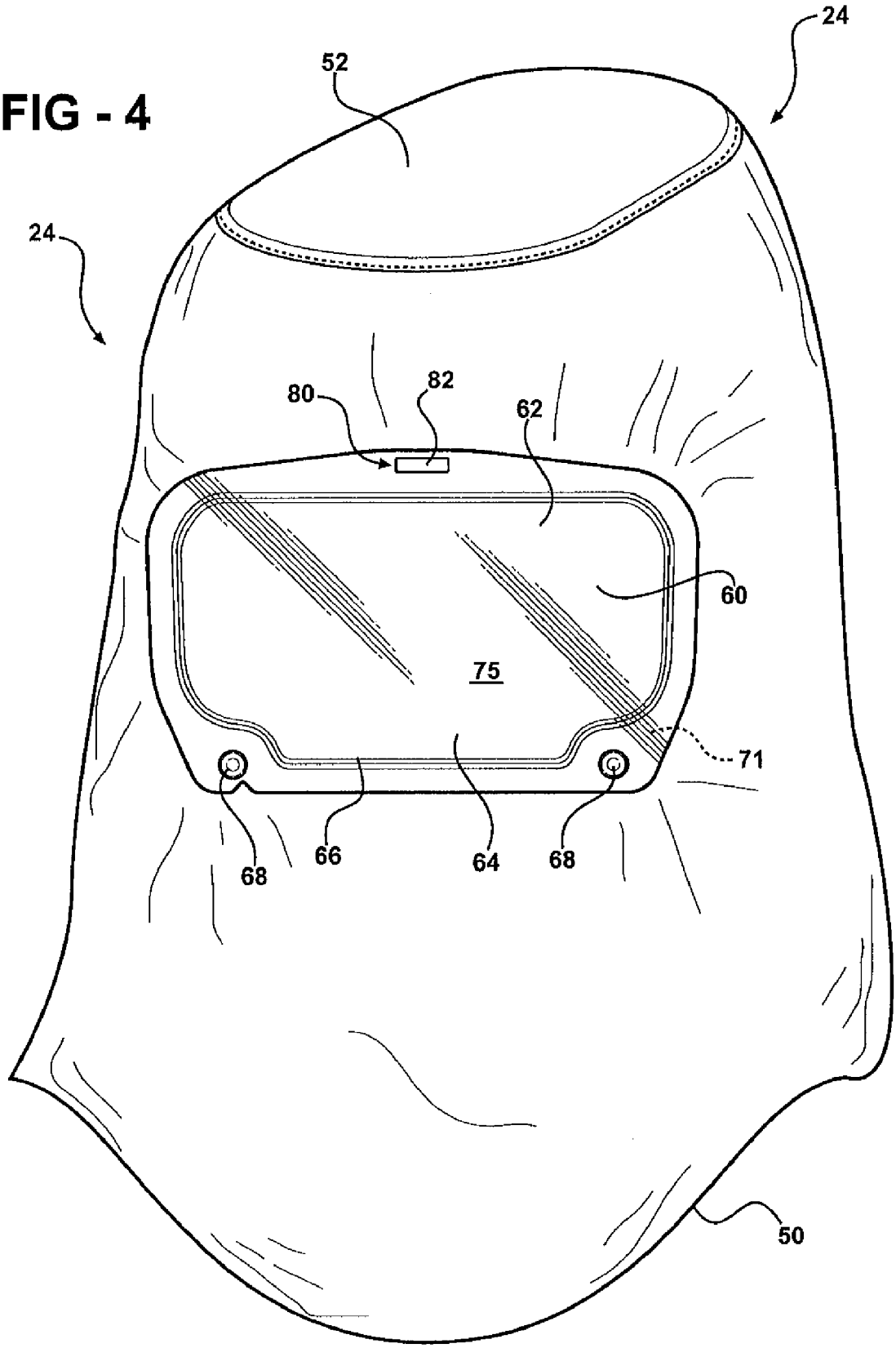
FIG. 4 is a rear view of the face shield with the protective covering being inside-out.
Figure 5:
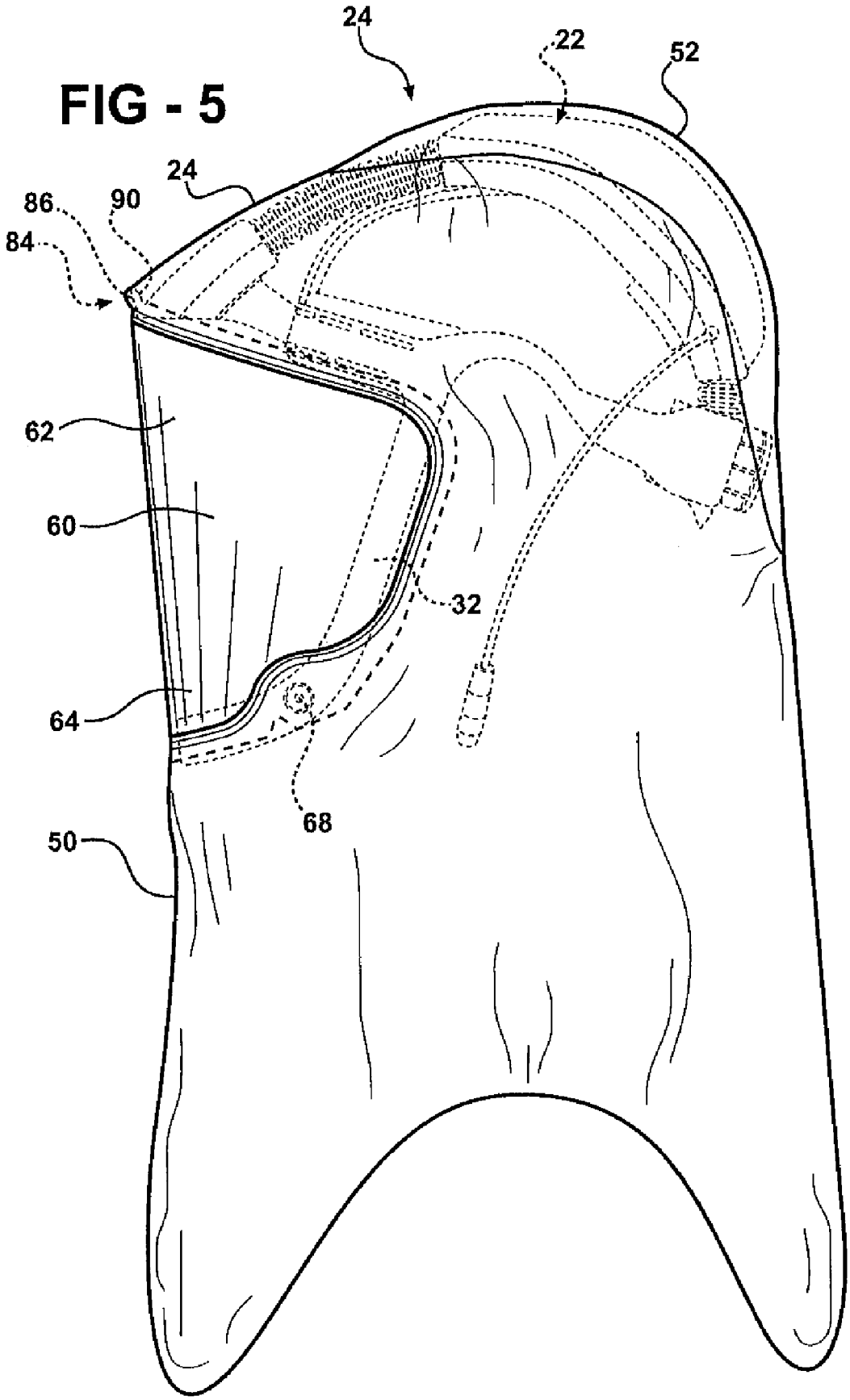
FIG. 5 is a side view of the protective covering.

Referring to FIGS. 3-5, the protective covering 24 is shown. In some embodiments, the protective covering 24 is a hood that drapes over the head unit 22 and terminates just over the wearer's shoulders. In other embodiments, the protective covering 24 is a toga that drapes over the head unit 22 and terminates near the wearer's feet. For purposes of illustration, the protective covering 24 that is shown and described is a hood 24.

The hood 24 includes a flaccid shroud 50. The shroud 50 includes a filter section 52 formed from a filter medium such as a meltblown or triboelectret nonwoven having a porosity suitable for filtering particles of 0.1 microns or greater from air entering the shroud 50 from the external environment. The remaining sections of the shroud 50 are preferably formed of a barrier fabric such as a multilaminate nonwoven comprised of polyethylene, polypropylene, or polyester, or any combination thereof, to prevent fluids and particulate from passing through the shroud 50. An intake grid 54 (see FIG. 12) spaces the filter section 52 out away from the fan 38.

A flexible and transparent face shield 60 permits the user to view through the hood 24. As shown in FIG. 1, the face shield 60 is mounted to the shroud 50 such that the face shield 60 covers the facial opening 34 of the head unit 22 once the user dresses into the personal protection system 20. The facial opening 34 of the head unit 22 receives the face shield 60.

Referring specifically to FIGS. 3 and 4, the face shield 60 includes a top portion 62, a bottom portion 64, and a sealing perimeter 66. The top portion 62 defines the top one-half of the face shield 60 and the bottom portion 64 defines the bottom one-half. The shroud 50 is sealed to the face shield 60 on an outside surface 67 of the face shield 60 along the sealing perimeter 66. The shroud 50 may be sealed to the face shield 60 by an adhesive or by welding. The face shield 60 has a height H, defined within the sealing perimeter, of at least 6.75 inches and a width W, perpendicular to the height H, defined within the sealing perimeter, of at least 10.5 inches. The minimum height H and width W are designed to provide a suitable viewing area for the wearer through the face shield 60. In particular, the width W provides a suitable peripheral view for the wearer to watch activities occurring to the sides of the wearer. The face shield 60 is preferably formed of a sterilizable material. In one embodiment, the face shield 60 is formed of Lexan® 8010 have a thickness of approximately 15 mils.

An upper mounting element 80 is disposed on the face shield 60 along the top portion 62 of the face shield 60. The upper mounting element 80 is preferably centered on the face shield 60 along the top portion 62. In one embodiment, the top portion 62 is free of mounting elements on opposing sides of the upper mounting element 80 such that the upper mounting element 80 is the only mounting element along the top portion 62. The upper mounting element 80 is preferably an aperture 82 defined through the face shield 60. The upper mounting element 80 is configured for fastening to an upper mounting device 84 included on the head unit 22.

The upper mounting device 84 is preferably centered on the head unit 22 relative to the facial opening 34. Preferably, the upper mounting device 84 is a single mounting clip 86 connected to the head unit 22, and that is positioned, preferably centered, relative to the facial opening 34.

As best shown in FIG. 2, the mounting clip 86 extends upwardly from a front nozzle assembly 88 of the head unit 22 (the front nozzle assembly 88 is described in detail in application Ser. No. 11/485,783 to VanDerWoude et al., hereby incorporated by reference) away from the facial opening 34 of the head unit 22 to support the face shield 60. The mounting clip 86 includes a distal edge 90 extending outwardly from the nozzle assembly 88 such that a portion 92 of the face shield 60 rests between the distal edge 90 and the nozzle assembly 88 after the face shield 60 is mounted to the mounting clip 86 to support the hood 24. The mounting clip 86 interlocks with the aperture 82 centered on the face shield 60 to automatically center the face shield 60 over the facial opening 34. More specifically, the mounting clip 86 protrudes through the aperture 82 when mounting the face shield 60 to the head unit 22.

Two lower mounting elements 68 are disposed on the face shield 60 along the bottom portion 64 of the face shield 60. The lower mounting elements 68 are preferably magnets or are formed of magnetically attractive material. In one embodiment, the lower mounting elements 68 are magnetic rivets mounted to the face shield 60. In this embodiment, the lower mounting elements 68 penetrate through the face shield 60. The lower mounting elements 68 are configured to fasten to lower mounting devices 70 on the chin bar 32 of the head unit 22 to secure the bottom portion 64 of the face shield 60 to the chin bar 32. See FIGS. 2 and 6. FIG. 2 shows only one of the lower mounting devices 70, but another lower mounting device 70 is positioned directly on the opposite side of the chin bar 32.

The lower mounting devices 70 are preferably magnets or are formed of magnetically attractive material configured to attract the lower mounting elements 68. This attraction makes it easier for the user to properly position the bottom portion of the face shield 60 on the head unit 22. In other embodiments, the lower mounting elements 68 and lower mounting devices 70 can be mating snap components, hook and loop fasteners, and the like.

The lower mounting elements 68 and the upper mounting element 80 are preferably mounted along an outer portion 71 of the face shield 60. The outer portion 71 is defined between an outer periphery of the face shield 60 and the sealing perimeter 66. As a result, when the shroud 50 is glued or adhered to the face shield 60 along the sealing perimeter 66, which is defined on the outside surface 67 of the face shield 60, the lower mounting elements 68 and the upper mounting element 80 are hidden beneath the shroud 50, out of view from an external perspective (see FIG. 3). This is particularly advantageous since the penetrations in the face shield 60 from the mounting elements 68, 80 would otherwise require some manner of ensuring that fluids and particulate could not penetrate therethrough. With the mounting elements 68, 80 disposed beneath the shroud 50, these penetrations are protected.

Referring specifically to FIG. 6, the upper 80 and lower 68 mounting elements define three mounting locations at which the face shield 60 mounts to the head unit 22. Although the head unit 22 is not illustrated in FIG. 6 for clarity, the face shield 60 is shown in its mounted configuration as though mounted to the head unit 22. The two lower mounting locations provide the face shield 60 with a first radius of curvature $R_1$ along the bottom portion 64 when the face shield is mounted to the head unit 22 using the lower mounting elements 68. The upper mounting location provides a second radius of curvature $R_2$ along the top portion 62 when the face shield 60 is mounted to the head unit using the upper mounting element 80. The first radius of curvature $R_1$ is smaller than the second radius of curvature $R_2$. This reduces glare that results from light being reflected off an inside surface 75 of the face shield 60 and directed toward the eyes of the user.

Preferably, the first radius of curvature $R_1$ is at least 4.0 inches and the second radius of curvature $R_2$ is at least 5.0 inches. The first radius of curvature $R_1$ preferably ranges from 4.0 inches to 10 inches, more preferably from 4.0 inches to 7.5 inches, and most preferably from 4.0 inches to 4.9 inches. The second radius of curvature $R_2$ ranges from 5.0 inches to 15 inches, more preferably from 5.0 inches to 10 inches, and most preferably from 5.0 inches to 6.0 inches. In one specific embodiment, the first radius of curvature $R_1$ is 4.6 inches and the second radius of curvature $R_2$ is 5.5 inches. A distance D between a first arc $A_1$ of the face shield 60 that lies at the first radius of curvature $R_1$ and a second arc $A_2$ that lies at the second radius of curvature $R_2$ is at least 6.75 inches, more preferably at least 7.5 inches. In one embodiment, the first arc $A_1$ is disposed at a bottom of the viewing area and the second arc $A_2$ is disposed at a top of the viewing area. The distance D may be defined along the height H of the face shield 60, which is perpendicular to an arc between the lower mounting elements 68.

By having a larger radius of curvature along the top portion 62, less light is reflected off the inside surface 75 of the face shield 60 toward the eyes of the user. This reduces glare. Instead, the light reflects off the face shield 60 to opposite sides of the user's eyes. This is illustrated in FIGS. 7A and 7B. In FIG. 7A, a prior art face shield is shown. This face shield has a relatively small radius of curvature such that the user's eyes receive significant amounts of reflected light in the form of glare. Conversely, the top portion 62 of the face shield 60 shown in FIG. 7B has a sufficiently large radius of curvature to direct reflected light out of the path of the user's eyes. Both the prior art face shield and the face shield 60 of the present invention can be designed with the same peripheral viewing distance P, but the face shield 60 of the present invention avoids glare.

Referring to FIG. 5, the shroud 50 is configured with an adequate amount of material and flexibility so as to not constrain the face shield 60 into a smaller radius of curvature than that indicated. In other words, the amount of material and configuration of the material for the shroud 50 permits some slack in the hood 24 when draped over the head unit 22 so that the face shield 60 can flex outwardly at the top portion 62 to be at the larger radius of curvature $R_2$. The face shield 60 is preferably formed from a generally flat piece of material that is then shaped to fit to the head unit 22 in the manner described. In the embodiment in which the top portion 62 is unattached on opposite sides of the upper mounting element 80, the top portion 62 flexes toward its normally flat position and is only constrained by the lower mounting elements 68. This allows the top portion 62 to flex further out than the bottom portion 64 giving the top portion 62 a larger radius of curvature.

Figure 8:
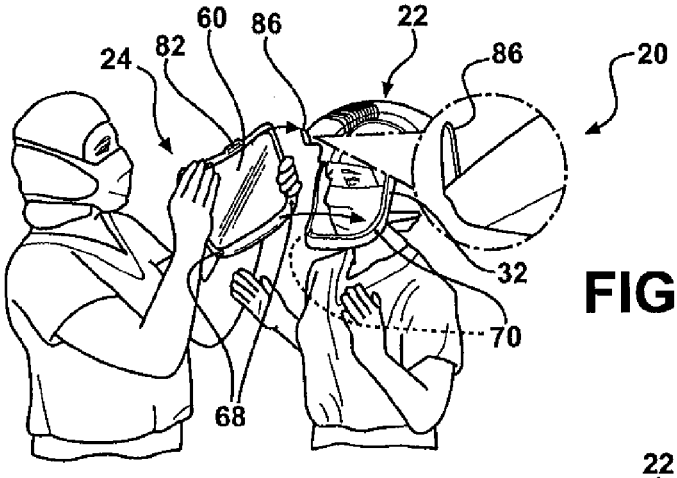
FIGS. 8-11 illustrate a procedure for mounting the protective covering to the head unit and draping the protective covering over the head unit.
Figure 9:
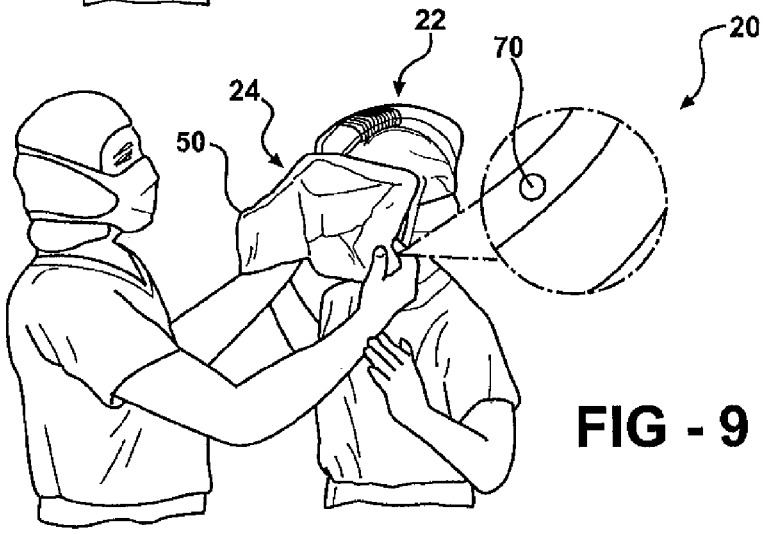
Figure 10:
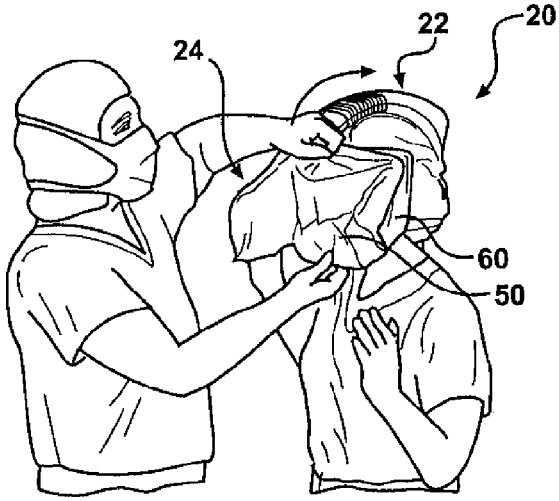
Figure 11:
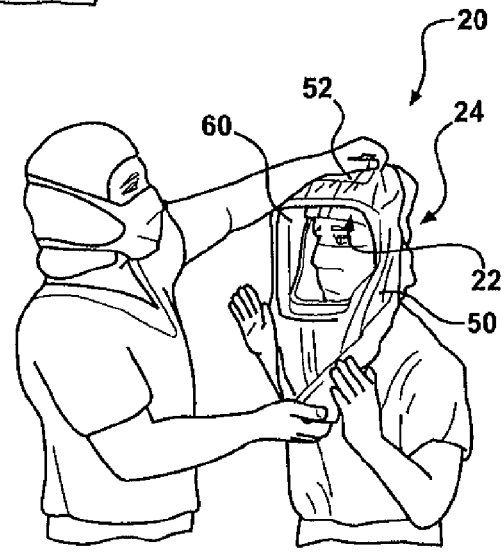

Referring to FIGS. 8-11, the steps taken to fit the system 20 onto a user are shown. As understood by those skilled in the art, users "dress into" the system 20 by first mounting the head unit 22 on their head. Next, as shown in FIGS. 8 and 9, the face shield 60 is mounted to the head unit 22. First, the aperture 82 is placed over the mounting clip 86. Second, the lower mounting elements 68 on the face shield 60 are fastened to the lower mounting devices 70 on the chin bar 32. As described above, this may simply require generally aligning the lower mounting elements 68 with the lower mounting devices 70 with magnetic forces fastening them to one another. Referring to FIGS. 10 and 11, once the face shield 60 is secured to the head unit 22, the shroud 50 is pulled over the head unit 22 and draped over the head unit 22 to provide a barrier between the user and the external environment. Although not shown, the user may then dress into a gown that accommodates the hood 24.

Since the mounting clip 86 and the aperture 82 are in the centered relationship described above, the face shield 60 is automatically centered relative to the facial opening 34 of the head unit 22, and there is no need for the user to repeatedly adjust the face shield 60.

Figure 12:
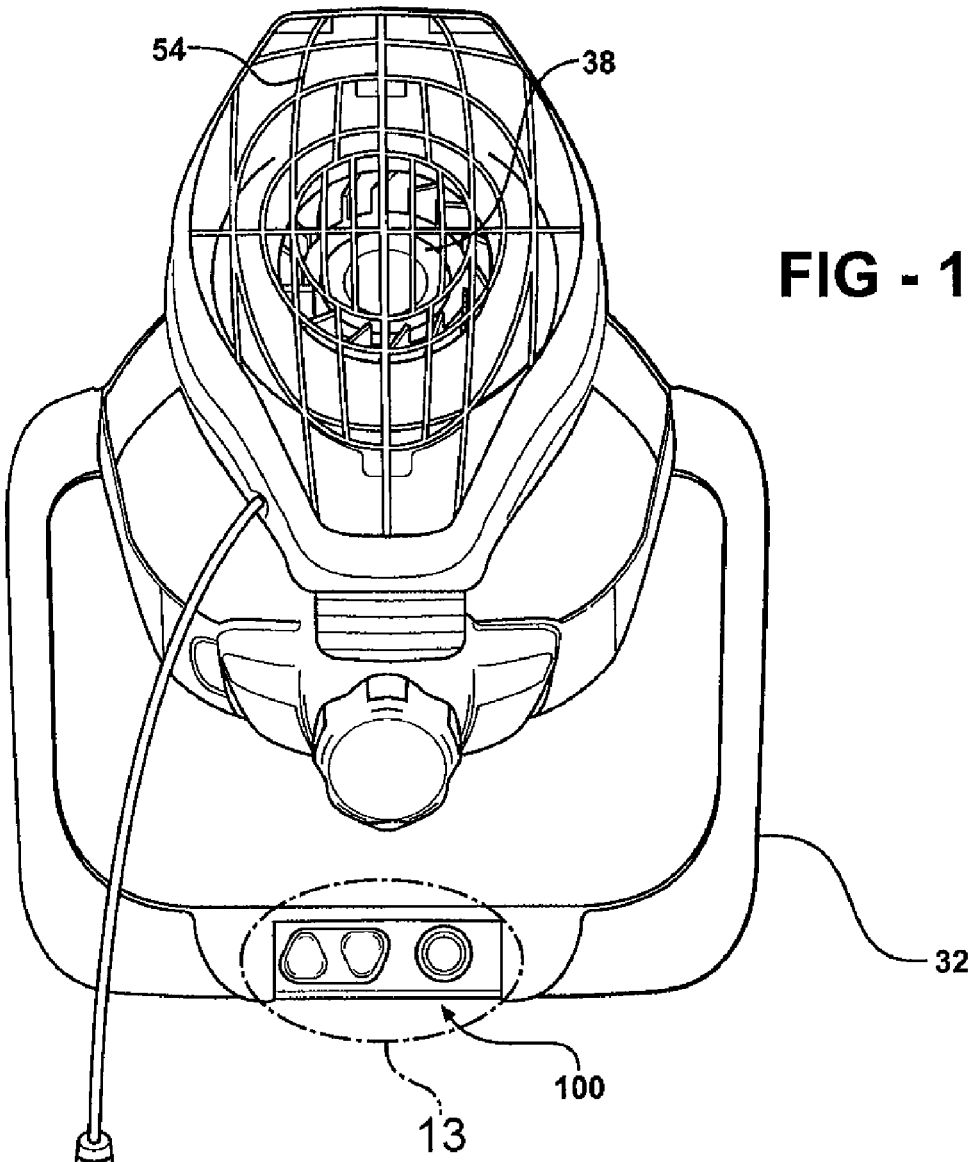
FIG. 12 is a rear view of the head unit including a control panel on a chin bar of the head unit.
Figure 13:
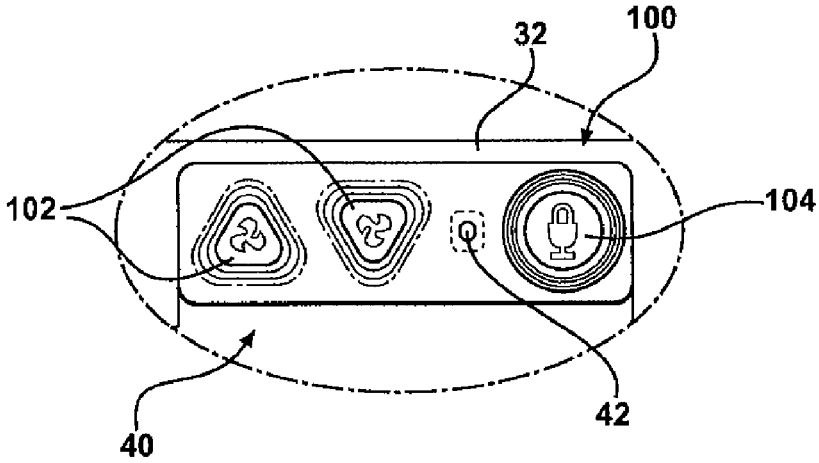
FIG. 13 is a blown-up view of the control panel from FIG. 12.

Referring to FIGS. 12 and 13, during use of the system 20, the wearer has access to a control panel 100 to adjust a speed of the fan 38 and to mute the microphone 42 of the communications unit 40. The control panel 100 is disposed on the chin bar 32. The control panel 100 preferably includes a plurality of control switches for the fan 38 and the microphone 42. In particular, referring specifically to FIG. 13, two fan control buttons 102 are shown for increasing and decreasing the speed of the fan 38. Similarly, a mute button 104 is shown for muting the communications unit 40. The fan control buttons 102 and the mute button 104 can be configured in the manner described in U.S. Pat. No. 6,481,019 to Diaz et al. or application Ser. No. 11/485,783 to VanDerWoude et al., both of which are hereby incorporated by reference for their disclosure of the operation of their fan control switches and muting switches.

Obviously, many modifications and variations of the present invention are possible in light of the above teachings. The invention may be practiced otherwise than as specifically described within the scope of the appended claims.

What is claimed is:

1. A protective covering for draping over a head unit to provide a sterile barrier between a user and an external environment, said protective covering comprising:

a flaccid shroud including a filter section for filtering air entering the shroud from the external environment;

a face shield formed of a flexible and transparent material and including a top portion, a bottom portion, and a sealing perimeter, said shroud sealed to said face shield along said sealing perimeter;

a pair of lower mounting elements disposed on said face shield along said bottom portion of said face shield; and an upper mounting element disposed on said face shield along said top portion of said face shield, said upper and lower mounting elements defining three mounting locations at which said face shield is mounted to the head unit;

said three mounting locations providing said face shield with a first radius of curvature along said bottom portion when said face shield is mounted to the head unit using said lower mounting elements and a second radius of curvature along said top portion when said face shield is mounted to the head unit using said upper mounting element, said first radius of curvature and said second radius of curvature being disposed in parallel planes, said first radius of curvature being smaller than said second radius of curvature to reduce glare directed toward the eyes of the user.

2. A protective covering as set forth in claim 1 wherein said first radius of curvature is at least 4.0 inches and said second radius of curvature is at least 5.0 inches.

3. A protective covering as set forth in claim 1 wherein said face shield has a height defined within said sealing perimeter of at least 6.75 inches and a width defined within said sealing perimeter of at least 10.5 inches for providing a viewing area to the user.

4. A protective covering as set forth in claim 1 wherein upper mounting element is centered on said face shield at said top portion and said top portion is free of mounting elements on opposing sides of said upper mounting element.

5. A protective covering as set forth in claim 1 wherein said upper mounting element is further defined as an aperture in said face shield.

6. A protective covering as set forth in claim 1 wherein said pair of lower mounting elements are further defined as a pair of magnets.

7. A protective covering as set forth in claim 1 wherein said pair of lower mounting elements are further defined as a pair of elements formed of magnetically attractive material.

8. A protective covering as set forth in claim 1 wherein each of said lower mounting elements penetrates through said face shield.

9. A protective covering as set forth in claim 8 wherein said face shield includes an outer periphery spaced from said sealing perimeter to define an outer portion of said face shield covered by said shroud.

10. A protective covering as set forth in claim 9 wherein said lower mounting elements and said upper mounting element are mounted to said outer portion of said face shield such that said mounting elements are covered by said shroud.

11. A personal protection system for providing a sterile barrier between a user and an external environment, said system comprising:

a head unit adapted to be worn on the head of the user, said head unit including:

a support structure;

a ventilation unit supported by said support structure, said ventilation unit having a fan that discharges air toward the user; and a chin bar depending from said support structure;

a protective covering draped over said head unit, said protective covering including:

a flaccid shroud including a filter section for filtering air entering the shroud from the external environment;

a face shield formed of a flexible and transparent material and including a top portion, a bottom portion, and a sealing perimeter, said shroud sealed to said face shield along said sealing perimeter;

a pair of lower mounting elements disposed on said face shield along said bottom portion of said face shield; and an upper mounting element disposed on said face shield along said top portion of said face shield, said upper and lower mounting elements defining three mounting locations at which said face shield is mounted to the head unit;

said face shield when mounted to said head unit provides a first radius of curvature along said bottom portion and a second radius of curvature along said top portion wherein said first radius of curvature and said second radius of curvature are disposed in parallel planes and wherein said first radius of curvature is smaller than said second radius of curvature to reduce glare directed toward the eyes of the user.

12. A personal protection system as set forth in claim 11 wherein said first radius of curvature is at least 4.0 inches and said second radius of curvature is at least 5.0 inches.

13. A personal protection system as set forth in claim 11 wherein said face shield has a height defined within said sealing perimeter of at least 6.75 inches and a width defined within said sealing perimeter of at least 10.5 inches for providing a viewing area to the user.

14. A personal protection system set forth in claim 11 wherein:

said head unit further comprising:

a pair of lower mounting devices disposed on said chin bar; and an upper mounting device disposed on said support structure;

wherein each of said lower mounting elements are fastened to one of said lower mounting devices on said head unit; and wherein said upper and lower mounting elements define three mounting locations at which said face shield is mounted to said head unit.

15. A personal protection system as set forth in claim 14 wherein upper mounting element is centered on said face shield at said top portion and said top portion is free of mounting elements on opposing sides of said upper mounting element.

16. A personal protection system as set forth in claim 14 wherein said upper mounting device is further defined as a clip and said upper mounting element is further defined as an aperture in said face shield for fitting over said clip.

17. A personal protection system as set forth in claim 14 wherein said pair of lower mounting elements are further defined as a pair of magnets and said pair of lower mounting devices are further defined as a pair of elements formed of magnetically attractive material for being attracted to said pair of magnets.

18. A personal protection system as set forth in claim 14 wherein said pair of lower mounting elements are further defined as a pair of elements formed of magnetically attractive material and said pair of lower mounting devices are further defined as a pair of magnets for attracting said pair of elements formed of said magnetically attractive material.

19. A personal protection system as set forth in claim 14 wherein each of said lower mounting elements penetrates through said face shield.

20. A personal protection system as set forth in claim 19 wherein said face shield includes an outer periphery spaced from said sealing perimeter to define an outer portion of said face shield covered by said shroud.

21. A personal protection system as set forth in claim 20 wherein said lower mounting elements and said upper mounting element are mounted to said outer portion of said face shield such that said mounting elements are covered by said shroud.

22. A personal protection system for providing a sterile barrier between a user and an external environment, said system comprising:

a head unit adapted to be worn on the head of the user, said head unit including:

a support structure;

a ventilation unit supported by said support structure, said ventilation unit having a fan that discharges air toward the user;

a chin bar depending downwardly from said support structure to define a facial opening for the user; and a control panel disposed on said chin bar, said control panel including at least one control switch for said ventilation unit;

a protective covering draped over said head unit, said protective covering including:

a flaccid shroud including a filter section for filtering air entering the shroud from the external environment;

a face shield formed of a flexible and transparent material and including a top portion, a bottom portion, and a sealing perimeter, said shroud sealed to said face shield along said sealing perimeter;

a pair of lower mounting elements disposed on said face shield along said bottom portion of said face shield; and an upper mounting element disposed on said face shield along said top portion of said face shield, said upper and lower mounting elements defining three mounting locations at which said face shield is mounted to the head unit;

said three mounting locations providing said face shield with a first radius of curvature along said bottom portion when said face shield is mounted to the head unit using said lower mounting elements and a second radius of curvature along said top portion when said face shield is mounted to the head unit using said upper mounting element, said first radius of curvature and said second radius of curvature being disposed in parallel planes, said first radius of curvature being smaller than said second radius of curvature to reduce glare directed toward the eyes of the user.

23. A personal protection system as set forth in claim 22 wherein said at least one control switch for said ventilation unit includes a pair of fan control buttons for increasing and decreasing a speed of said fan.

24. A personal protection system as set forth in claim 22 wherein said head unit includes a communications unit and said control panel includes a microphone for said communications unit.

25. A personal protection system as set forth in claim 24 wherein said control panel includes a mute button for muting said communications unit.

* * * * *